US007001100B1

(12) United States Patent
Attar

(10) Patent No.: US 7,001,100 B1
(45) Date of Patent: Feb. 21, 2006

(54) MONOLITHICALLY FORMED ONE-PIECE REFLECTIVE PAVEMENT MARKER

(76) Inventor: Adil H. Attar, P.O. Box 3883, Ontario, CA (US) 91761

( * ) Notice: Subject to any disclaimer, the term of this patent is extended or adjusted under 35 U.S.C. 154(b) by 0 days.

(21) Appl. No.: 10/979,385

(22) Filed: Nov. 1, 2004

(51) Int. Cl.
*E01F 11/00* (2006.01)

(52) U.S. Cl. ..... 404/16; 404/12; 404/15

(58) Field of Classification Search ..... 404/11–16
See application file for complete search history.

(56) References Cited

U.S. PATENT DOCUMENTS 2,225,496 A * 12/1940 Gethin et al. ..... 404/12
5,002,424 A * 3/1991 Hedgewick ..... 404/14
5,242,242 A * 9/1993 Young ..... 404/12
5,667,334 A * 9/1997 Boyce ..... 404/9
5,667,335 A * 9/1997 Khieu et al. ..... 404/14
6,334,734 B1 * 1/2002 Attar ..... 404/16
6,347,906 B1 * 2/2002 Schuler ..... 404/16
6,579,036 B1 * 6/2003 Attar ..... 404/16
2002/0184881 A1 * 12/2002 Oka ..... 60/329

* cited by examiner

*Primary Examiner*—Raymond W Addie

(57) ABSTRACT

A reflective pavement marker having a structural body and at least one retro-reflective face. The pavement marker having angled sides, each having a designated lower impact region, and a slanted finger grip region. The marker further having a base sealing sheet with texture outside surface, the at least one reflective face has an abrasion resistant coating and the marker can be colored in a single or multiple colors. At least two guide pins are received in corresponding guide pin slots, to facilitate joining two marker halves together.

8 Claims, 8 Drawing Sheets

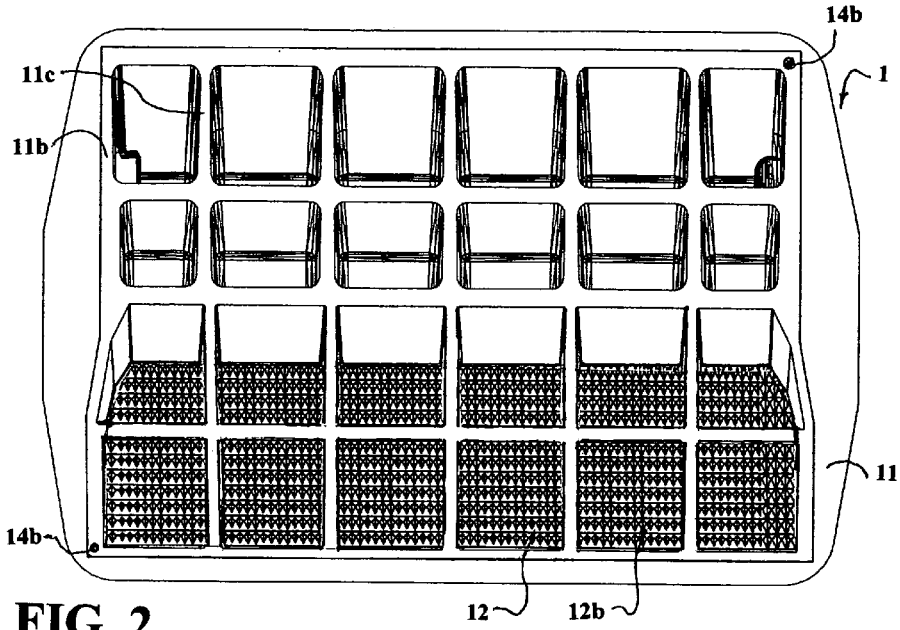
FIG. 2
FIG. 1
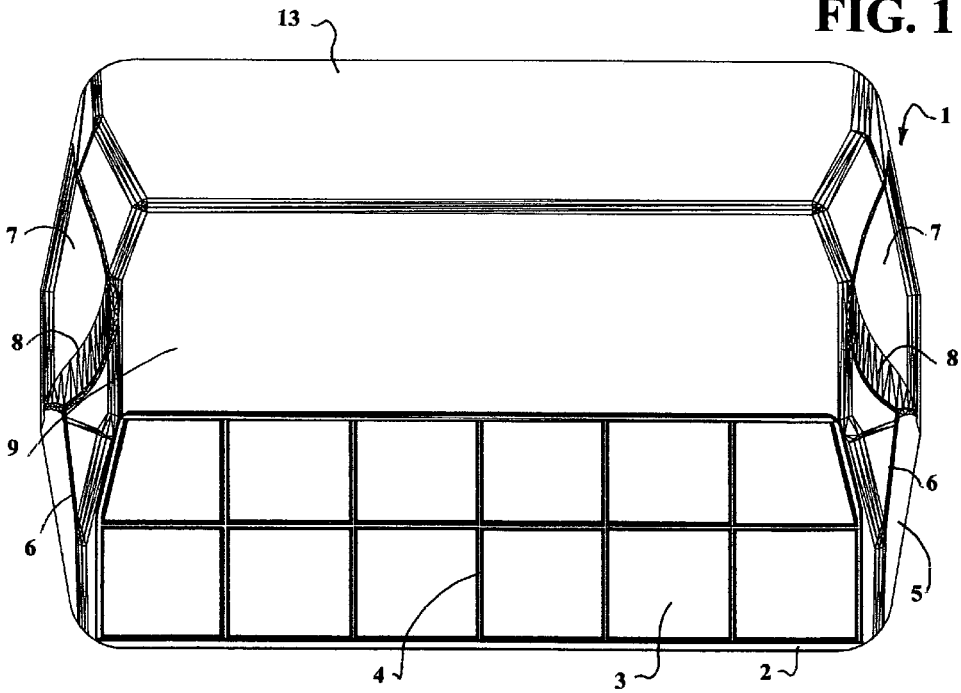

FIG. 9
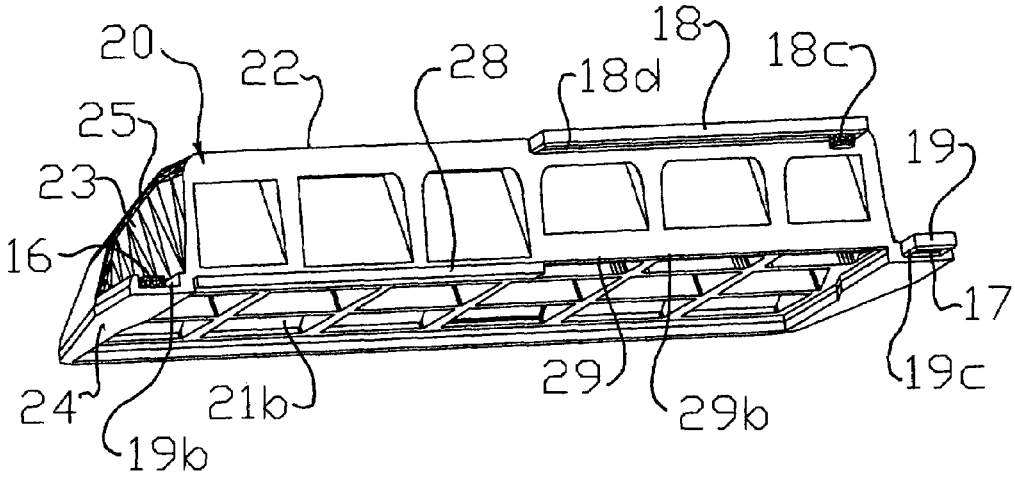
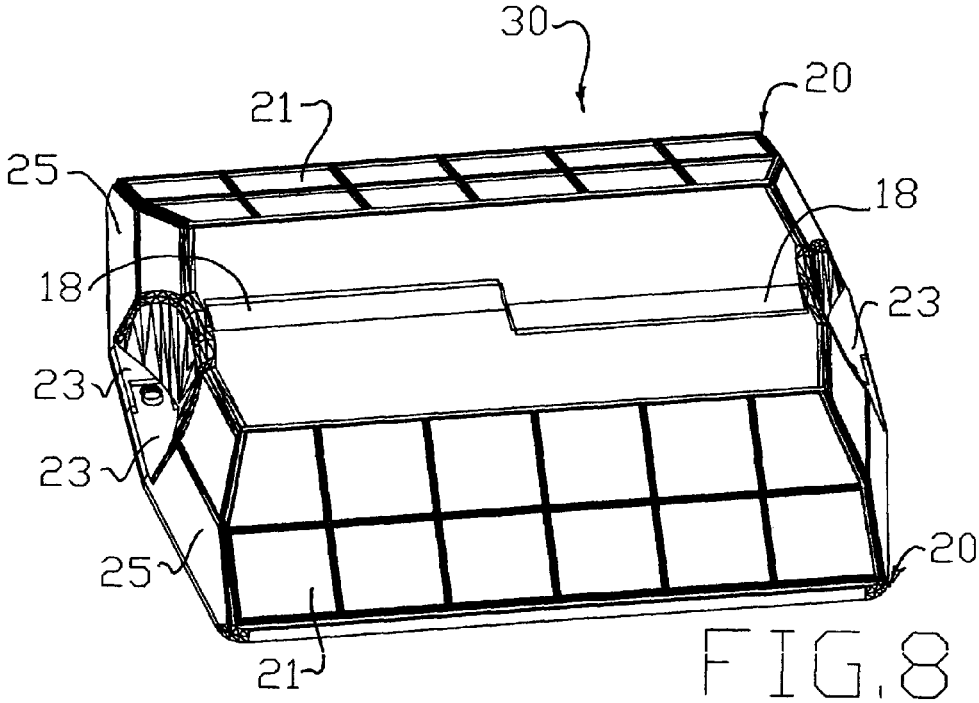
FIG. 8

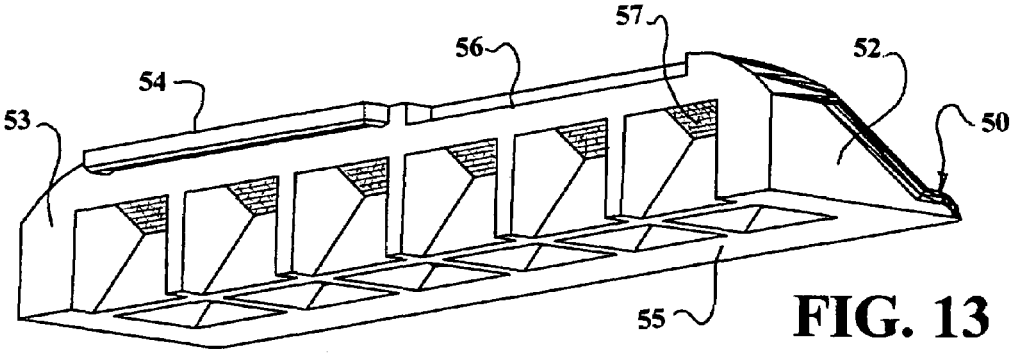
FIG. 13
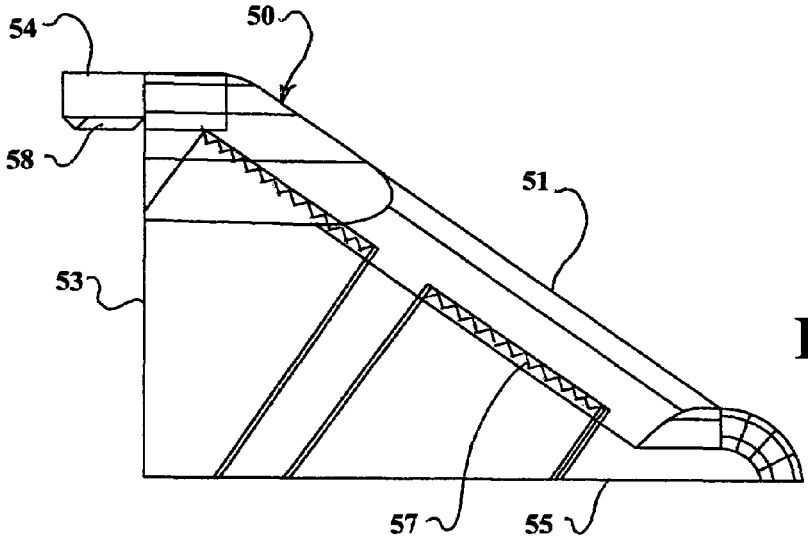
FIG. 14
FIG. 15
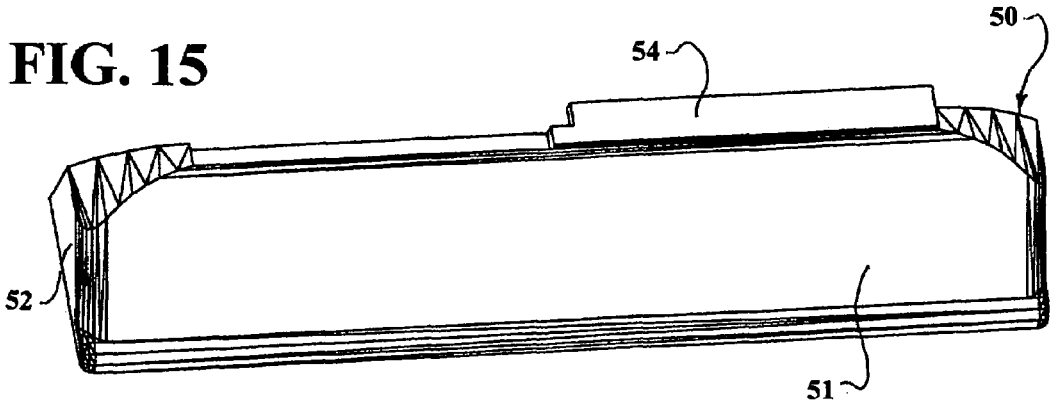

MONOLITHICALLY FORMED ONE-PIECE REFLECTIVE PAVEMENT MARKER

BACKGROUND OF THE INVENTION

1. Field of the Invention

This invention relates to the process of integrally forming one-piece roadway markers with multi angled sides having designated impact regions to minimized vehicle impact, which are used as traffic lane divider retro-reflecting light from oncoming vehicles, thereby delineate the roadway to the driver.

2. Related Art

Roadway markers are adhered to pavements along centerlines, edge lines, lane dividers or guardrail delineators.

Since 1965, the most commonly used retroreflective roadway markers are based on Heenan U.S. Pat. No. 3,332,327 and Balint U.S. Pat. No. 3,409,344.

Typically, these types of markers are produced in a process consisting of three to four steps:

Firstly, injection molding of a thermoplastic shell, either integrally molded with the reflective face, or the reflective faces welded on a corresponding open recesses within the shell.

Secondly, either the reflective faces within a shell or the entire inside surface of the shell coated with a reflective metallic sealer by a process known as vacuum metalizing.

This metallic sealer needed firstly to protect the cube corner reflective elements and to retain part of retro-reflection after filling the shell with a thermosetting resinous material, such as inert filled epoxy or polyurethane resin.

This resinous filler material encapsulate the metalized cube corner reflective elements and form the marker's structural body. Finally, a layer of relatively course sand or glass beads dispersed over the top surface of the filler material prior to solidification of the filler material. Part of the sand particles will remain partially protruding above the planar base surface of the marker, thereby increase the adhesive welding parameter of the base surface. The protruded sand will improve adhesion to substrate, regardless of the type of adhesive used. This type of markers worked well for six or seven months, however, due to poor abrasion and impact resistant of the thermoplastic shell, over 60% of the reflectivity lost thereafter. Also, incompatibility of the shell material to the resinous filler material causes pealing of the reflective face or the shell, thereby losing retroreflectivity.

Several attempts were made to improve abrasion resistant of the reflective face. One was the use of thin layer of untempered glass as disclosed in U.S. Pat. No. 4,340,319, another attempt was the use of polymeric coating of the reflective face, as disclosed in U.S. Pat. No. 4,753,548 to (Forrer). These abrasion resistant coating proving to be expensive and tend to reduce retro reflectivity. Other major development in the pavement marker art has been made, this was achieved by eliminate the use of the metalized sealer for the cube corner reflective elements. U.S. Pat. No. 4,227,772 (Heenan); U.S. Pat. Nos. 4,232,979; and 4,340,319 (Johnson et al) disclosed pavement markers having non-metalized reflective faces. This was achieved by dividing the inside surface of the reflective face into reflective cells, with each cell retaining several cube corner reflective elements. The cells are isolated from each other by partition and load carrying walls. The reflective face is welded to a correspondingly recessed face within a hollowed structural body, thereby retaining the reflective prisms in an air space. These markers proved to be superior in reflectivity, however, they lacked structural strength and showed poor adhesion to the roadways, causing short life cycle and in some regions had the tendency to shift location on the roadways. This applicant successfully developed a one-piece reflective roadway marker, which is a monolithically injection molded reflective pavement marker including a reflective prismatic face, structural body and a hollowed base that is sealed with a compatible plastic sheeting. This one-piece marker was disclosed in this Applicant's U.S. Pat. Nos. 6,334,734 and 6,698,972. The '734 and '972 patents disclosed one-piece reflective markers that proved to have better structural stability and consistently the same retro-reflective value, due to being homogeneously injection molded under a very high pressure and from one type of moderate to high impact resistant polymer.

However, there is no recognition apparent from the '734 and '972 patents that there is a need for designating lower impact regions within the marker inclined sides. The '734 and '972 did not recognize the need for providing the designated marker's side grip regions with angular surface equal to the angle formed by the centerline of each hollow cavity defining the interior structural walls, which eliminate the usage of the costly process of using slides for the injection molding tooling.

Also the '734 and '972 patents did not recognize that the base sealer sheet need to be injection molded having a thickness of at least about 0.07 to 0.10 inch, with textured and grooved outer surface as well as an inside surface with energy directors and at least two guiding pins for improved sonic welding and providing such sealer sheet with definitive periphery geometric shape to avoid wasted welding time.

It has been discovered that a reflective pavement marker with two reflective faces can be formed by injection molding only a half marker monolithically including one reflective face, interior structural walls, at least two tong and groove means with energy directors and at least one guiding pin means. Two half markers are then attached to each other through the guiding pin means, thereby firmly aligning the tong and groove slots to be sonically welded.

It has also been discovered that a double sized reflective pavement marker can be formed utilizing the process of the present invention. Such double sized reflective markers are favorably needed for use in the double stripping portions of Freeways and roadways, such as the entrance or exit lanes and other commonly known as the Y intersections junctions of two splitting roadways.

This application also provides the means for an improved reflective face with maximum retro-reflective cells and a streamlined body for smoother and reduced vehicular impact.

Also it is the desire of this application to have an improved method for abrasion resistant coating the outer marker body, inclusive the reflective face. This can be achieved economically by spraying the entire outside surface of the marker with coating composition such as the teaching of U.S. Pat. No. 4,486,504 assigned to General Electric Company which utilizes acrylates with functional silanes or the teaching of U.S. Pat. No. 5,126,394 and U.S. Pat. No. 5,648,173 assigned to Dow Corning corporation which provide a room temperature, moisture curable abrasion resistant coating compositions having multifunctional acrylate.

SUMMARY OF THE INVENTION

This invention pertains to improved molding process for monolithically injection molding a one-piece reflective roadway marker having contoured geometric sides with finger grip slots and lower vehicular impact region. The contoured and angular geometric surfaces of the marker allow the use of a simple injection molding process without the need for three dimensional mold slides.

The one-piece reflective marker of the present invention integrally contain cube corner reflective prisms within at least one reflective face, interior structural walls and a planar base having a large recessed area with energy directors and slots for guiding pins for placing a grooved sealing sheet, thereby provide better adhesion to the pavement and higher resistance to flexural stresses.

Another objective of the present invention is to provide an improved one or two step injection molding process for manufacturing one-piece reflective pavement markers, while retaining maximum reflectivity, improving structural strength and providing streamlined exterior geometry for reducing vehicular impact.

This can be achieved by geometrically providing lower exterior regions within the marker inclined sides for vehicular impact, providing improved finger grip slots with angular surface equal to or less than the angle between each centerline for hollow cavities defining the interior structural walls and the planar base surface.

The angular positions of the finger grip slots eliminate any under-draft within the exterior geometry of the marker sides, thereby allowing the use of a simple production mold with one directional movement.

Another objective of the present invention is to provide an injection molded base sealer sheet having a thickness of about 0.07 to 0.10 inch, with textured and grooved outer surface as well as an inside surface with energy directors and at least two guiding pins for improved sonic welding the sealer sheet to the marker base area and providing the sealer sheet with definitive periphery geometry to avoid wasted welding time.

Another objective of the present invention is to provide a method for forming a double sized one-piece reflective pavement marker with about 8 to 10 inches in width and about 3 to 5 inch depth, which are favorably needed for use in the double stripping portions of Freeways and roadways, such as the entrance or exit lanes and other commonly known as the Y intersections junctions of two splitting roadways.

Yet another objective of this invention is to provide the means for improved and less costly process for spray or dip coating an abrasion resistant coating composition for the exterior surfaces of the one-piece reflective marker.

BRIEF DESCRIPTION OF THE DRAWINGS

The advantages and unique features of this invention will be better understood by reference to the drawings. These drawings are schematics, no scale used. In the drawings:

FIG. 1 is a plan view of an improved one-piece pavement marker of the invention showing the inclined sides with the angular grip slots;

FIG. 2 is a plan view of the one-piece pavement marker illustrated in FIG. 1 showing the open cavities within the planar base surface;

FIG. 8 is an isometric view of a reflective marker form by welding two markers of FIG. 7.

FIG. 9 is an isometric view of the one half marker of FIG. 7 showing the back sides and a sealed base region;

FIG. 13 is an isometric view of yet another low profile one half reflective marker;

FIG. 14 is a side view or the half marker of FIG. 13;

FIG. 15 is an isometric view of the half reflective marker of FIG. 13;

DESCRIPTION OF THE PREFERRED EMBODIMENTS

Figure 5:
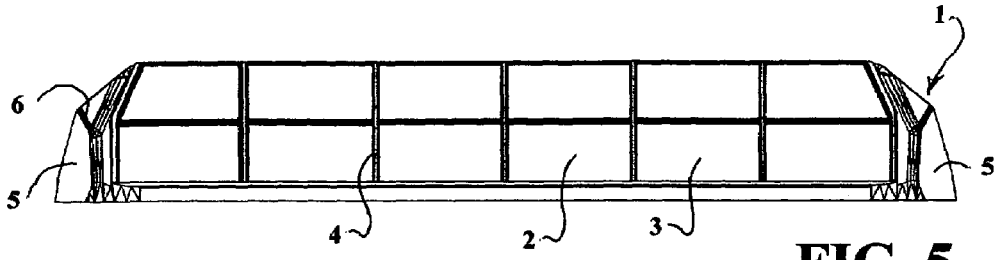
FIG. 5 is an elevation view showing the reflective face for marker of FIG. 1.
Figure 4:
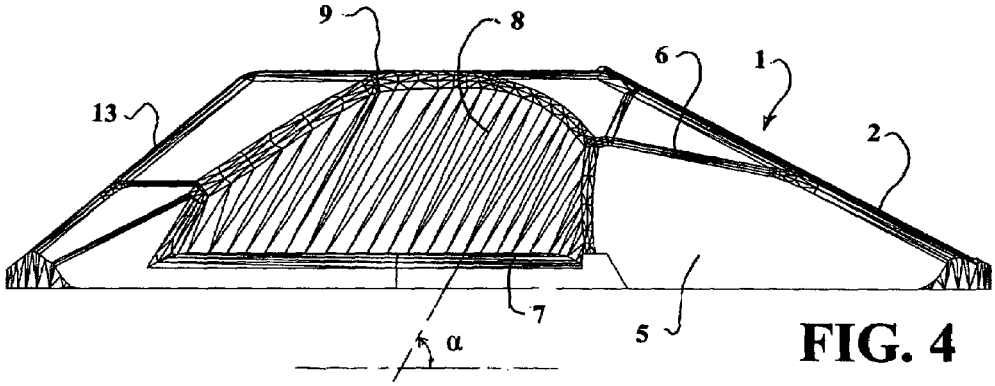
FIG. 4 is a side view for the marker in FIG. 1 showing the angular surfaces of the grip regions for each inclined side.
Figure 3:
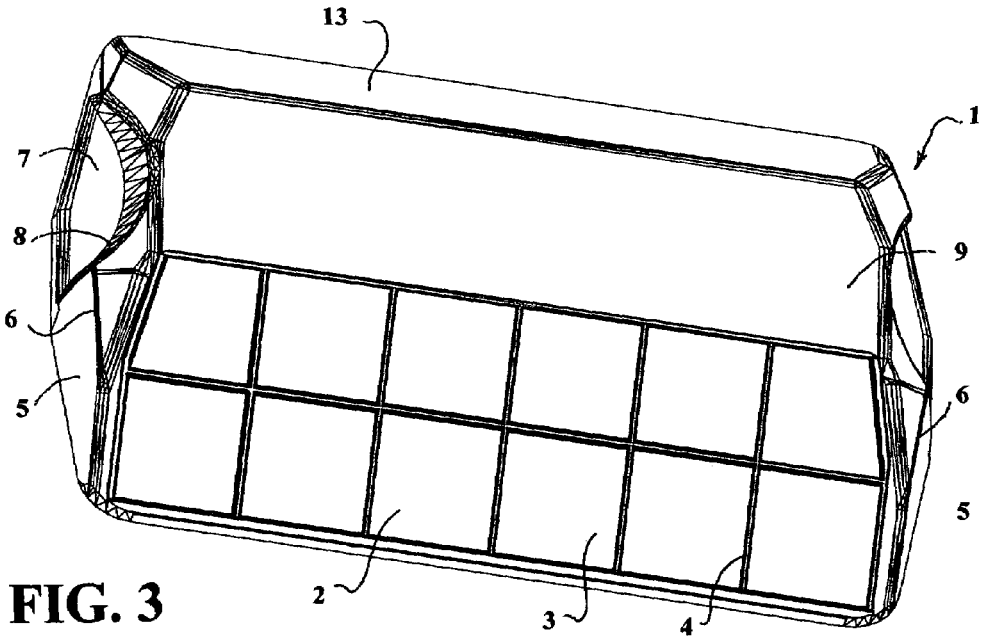
FIG. 3 is an isometric view of the one-piece marker of FIG. 1.

Referring to FIGS. 1 through 6 represent one of the improved embodiment of a monolithically formed one-piece reflective pavement marker designated by the number 1. The one-piece marker 1 is integrally made with two color segments, an inclined transparent planar reflective face 2 with multiple of raised bumpers 4 of about 0.01 to 0.03 inch in height defining cell like reflective areas 3 and an opaque body segment which comprises a top planar portion 9, an inclined non-reflective back surface 13, two inclined sides 5 each having multi angular surfaces defining impact region 6, each inclined side 5 includes a finger grip slot 7 having side surface 8 that is slanted, thereby forming an angle $\alpha$ with the horizontal plane.

Pavement marker 1 also includes a planar base surface 11 with the open ends of the hollow cavities 12 defining reflective cells 12*b*, the structural walls 11*c*, at least two guiding pin slots 14*b* within a designated recessed area 11*b*. Recessed area 11*b* is provided for attaching and welding a sealer sheet 15 to enhance welding parameter. A preferred sealer sheet 15 is shown in FIG. 6 in a transparent color.

Figure 6:
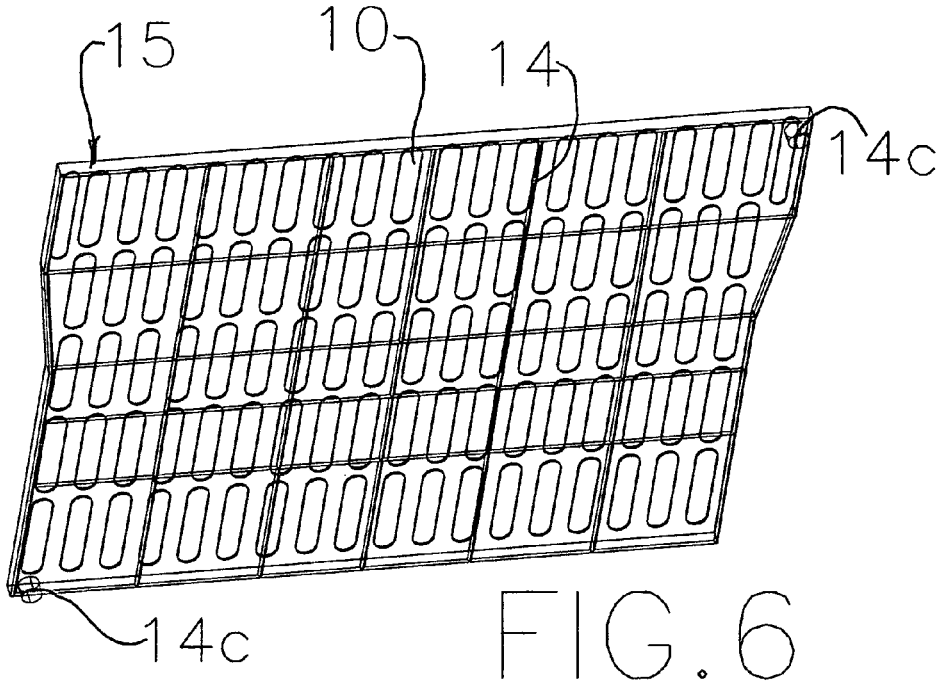
FIG. 6 is an isometric view of the base sealer sheet used for sealing the open base region for marker in FIG. 1.
Figure 7:
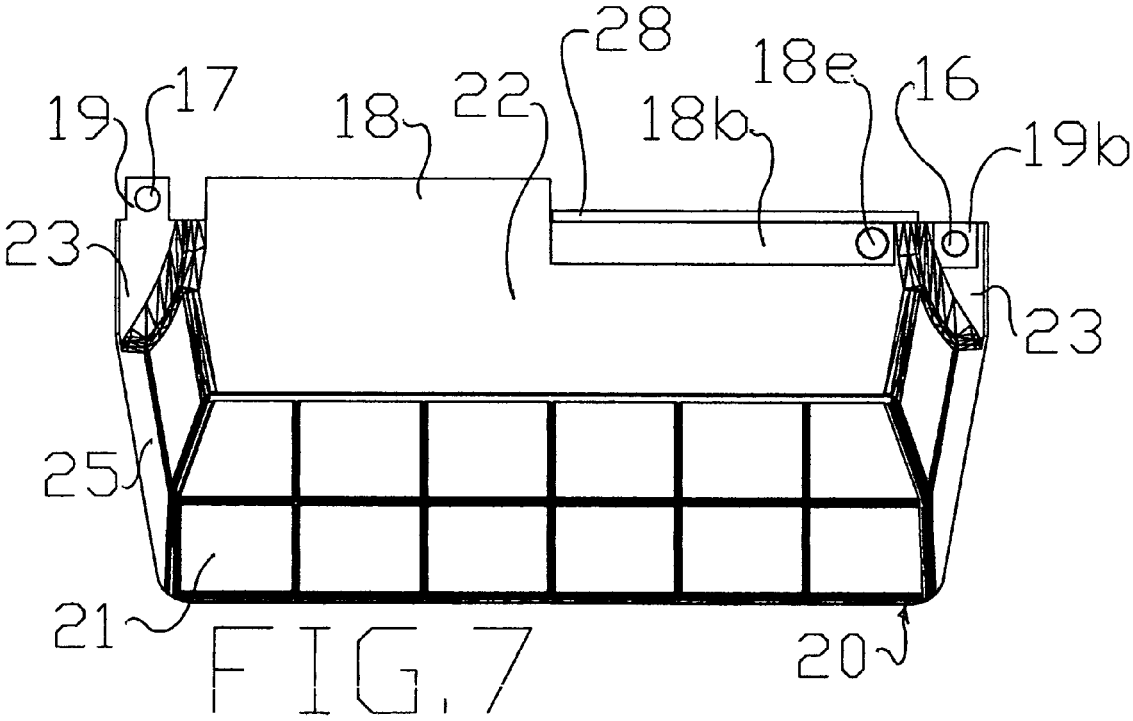
FIG. 7 is a plan view of one half of a reflective marker with two reflective faces.

FIG. 6 shows a perspective view of sealer sheet 15 with energy directors 14 and two guiding pins 14*c* on the interior surface and multiple of recesses 10 on the exterior surface.

The reflective pavement marker 1 can be formed within the applicable standard dimensions and specifications acceptable in the highway safety fields, such as having a width of about 4 to 10 inches, a depth of about 2.0 to 4.0 inches and a height of about 0.40 to 0.75 inch.

The present invention includes an improved one-piece reflective marker having two inclined sides 5 with improved lower impact region 6. Each inclined side 5 includes a finger grip region 7 having angular surface 8 that lies within a plane that is nearly at a right angle to the plane of the reflective face 2, thereby allowing the one-piece reflective marker of the present invention to be manufactured utilizing simple conventional, two dimensional mold without the use of costly molding slides.

Conventional one-piece markers, delineators, snow plowable insert markers and temporary markers are discussed in details in U.S. Pat. Nos. 6,334,734 and 6,698,972, which are herein incorporated by reference.

There has been an attempt to provide side finger grip slots for the one-piece markers based on '734 and '972 patents. There is no recognition apparent from the '734 and '972 patents that there is a need to provide an acute angle for the upper surface 8 of the finger grip slots 7.

It has been discovered that positioning surface 8 (FIG. 4) within a plane near perpendicular to the plane of reflective face 2 will simplify the process of building the production mold for the one-piece reflective marker 1, thereby considerably improving the quality of forming the optical elements within the retro-reflective face 2. This angle ($\alpha$) with respect to the horizontal plane is about 58° to 62° and preferably 61°.

The production mold for a one-piece reflective marker with finger grip slots that is based on the '734 and '972 patents needed costly and complicated slides, due to the angular deferential, commonly described as under-draft, between the open-close movement of the mold which lies in a plane (y-axis) that is at a right angle to the plane (x-axis) which is parallel to the planar reflective face 2, and the over all surface 8 alignment within the finger grip slots 7 of the marker's inclined sides 5.

The process of forming pavement marker 1 provides the means to integrally form multiple of cube corner reflective elements within the designated interior cell like areas 12*b*.

The geometrically pre-defined heights of impact region 6 within the inclined sides 5 of marker 1 will define the region of contact or impact from oncoming vehicular tires.

By providing two distinct angular surfaces within each inclined side 5, an intersection level or region 6 is defined. This region 6 is about 0.25 to 0.40 inch above the marker 1 planar base area 11 directly above the pavement surface to which marker 1 is agglutinated.

This impact region 6 is considerably lower than the top planar surface 9 of marker 1.

This lower impact region 6 minimizes stresses on the marker face 2 and allow smoother ride to the oncoming traffic, thereby minimize ware and tear of the pavement marker reflective face.

Also FIG. 1 shows that the multi angled sides 5 are formed slightly slanted within the horizontal plane, each forming an angle of about 95 to 105 degrees with respect to the base lines of the front face 2 and back face 13.

Figure 11:
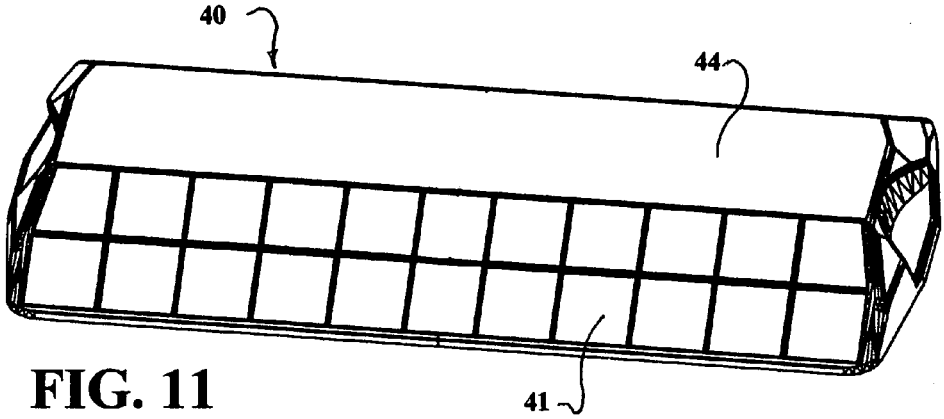
FIG. 11 is an isometric view of a one piece reflective double marker.
Figure 12:
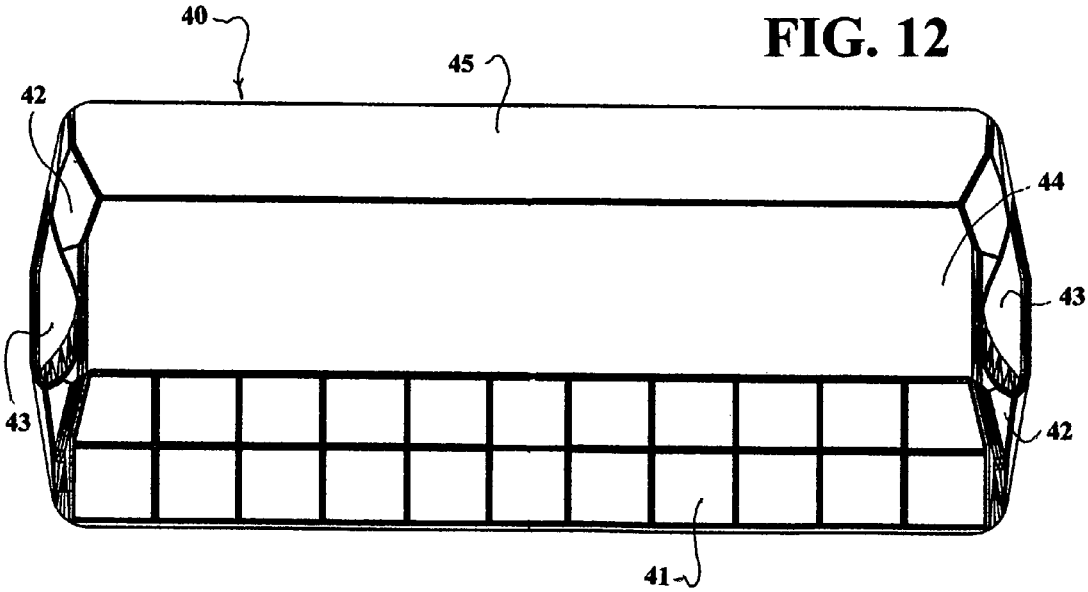
FIG. 12 is a plan view of the double reflective marker of FIG. 1.
Figure 16:
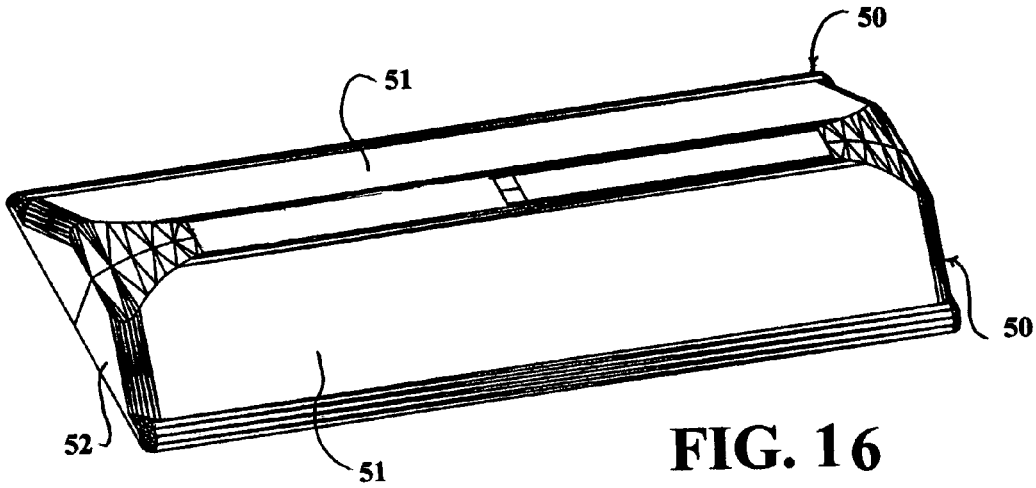
FIG. 16 is an isometric view of two half markers of FIG. 13 welded together forming a mini marker or snow marking insert with two reflective faces.

These slanted surfaces of sides 5 will provide larger daytime visibility for the vehicular traffic. The same principle can be applied to provide the means for forming a half reflective marker 20 shown in FIGS. 7–10 and FIGS. 13–15 or a double size reflective marker 40 shown in FIGS. 11–12. The illustrated embodiments of FIGS. 1I and 12, reference numeral 40 designates a monolithically formed, double size one-piece reflective marker that includes an inclined reflective face 41, a planar top surface 44, an inclined back surface 45 and two multi-angle sides 42 each side includes a finger grip slot 43. Marker 40 is provided with a recessed area within the base surface for receiving and sonically welding a sealer sheet similar to sealer sheet 15 of FIG. 6, which is made to proportionately fit the recessed area of marker 40.

The double size reflective marker 40 is typically formed having an extra large width dimension of about 8.0 to 10.0 inches, a depth of about 3.0 to 5.0 inches and a height of about 0.50 to 0.75 inches. The polymer of choice for making reflective markers 1 and 40 is polycarbonate.

The extra large width of double size marker 40 will correspond to the typical designated double stripping regions at freeways acute intersections, which typically known as the "Y" intersections for two parting or merging freeway or roadway lanes. This type of double sized markers 40 can also be used at the acceleration and deceleration lanes of freeway entrances and exits, where double width paint stripping are normally being used. In contrast to present practices, where two, 4 inch wide standard markers are agglutinated side by side within a double stripping region.

The double size marker 40 minimizes the vehicular impact stress and reduces installation time. The structural strength of marker 40 makes it more durable than the present epoxy filled reflective markers, because, each reflective cell within the reflective face 41 is independently protected by its own interior structural walls, similar to structural walls 11*c* of marker 1, which is illustrated in (FIG. 2).

Also there has been an attempt to form a one-piece marker with two reflective faces based on the 734 and 972 patents, by forming two half pieces, each with one reflective face, which are interconnected with ties and without recognizing the need for a tong and groove means, energy directors or guiding pins to firmly align the two opposite halves prior to sonic welding them together.

In the illustrated embodiment of FIGS. 7–10, there is shown half reflective marker 20 integrally formed with two color segments, a transparent reflective face 21 and an opaque body. The body comprises an interior with multiples of cavities 21*b*, 21*c* and 21*d*, a planar top 22 with a tongue 18 having a guiding pin 18*c*, energy directors 18*d* corresponding to a matching groove 18*b* including a guiding pin slot 18*e* and two inclined sides 25 each includes one half of a slanted finger grip slot 23 with matching tongue 19 including a guiding pin slot 17 and energy directors 19*c* and a groove 19*b* as part of the opposing finger grip slot 23 which includes a guiding pin 16.

Figure 10:
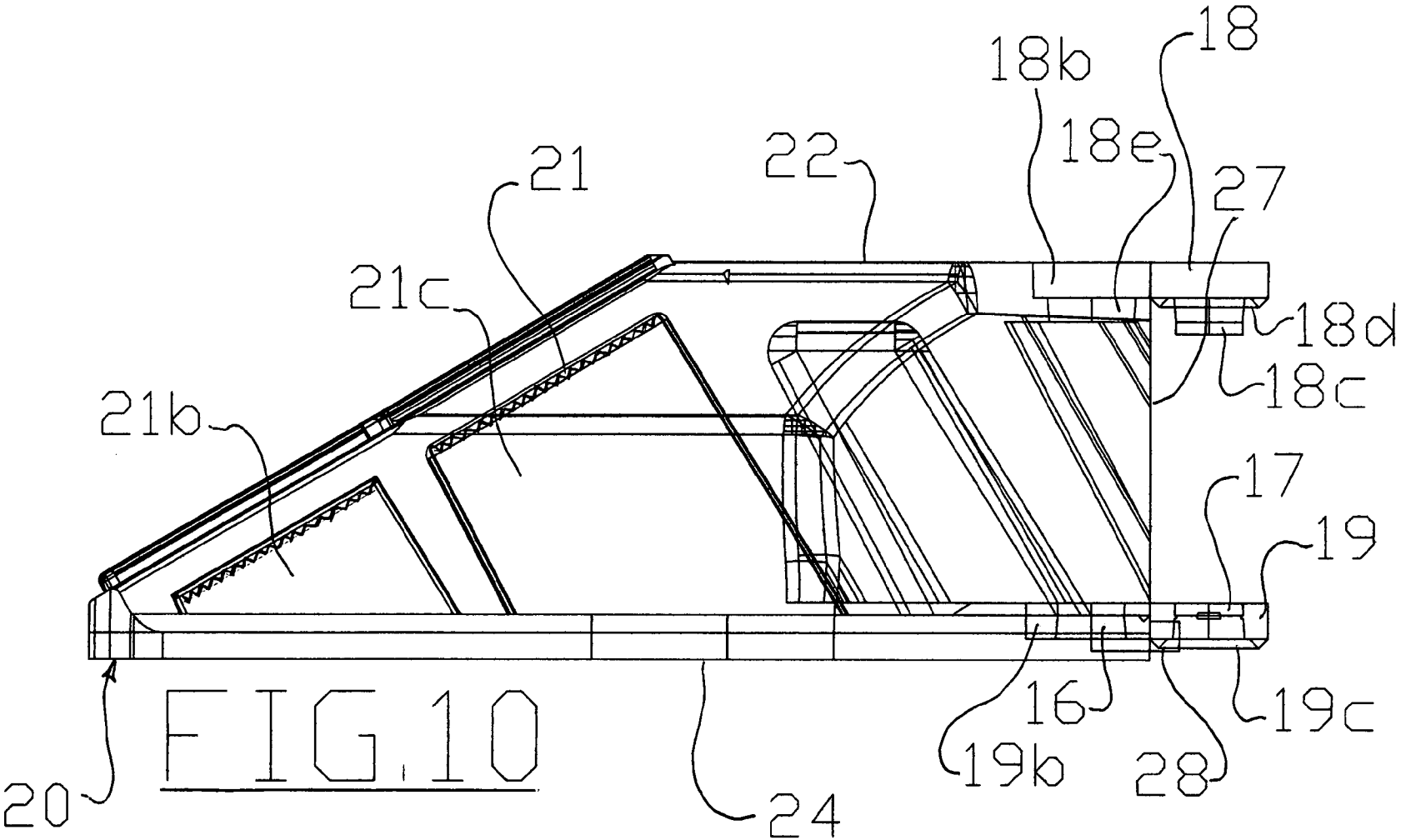
FIG. 10 is a side view for the one half marker of FIG. 7.

FIGS. 9 and 10 illustrate half marker 20 with an additional matching tongue 28 and groove 29 means that can be incorporated as integral extension of the base area at the lower vertical back portion 27 for added bond surface. Also shown in FIG. 9 is the base area 24 of a half reflective marker 20. This additional tongue 28 and groove 29 regions within the base 24 will increase bonding strength especially when a transparent adhesive is applied to bond the two half markers 20 instead of a sonic welding process. FIG. 8 shows two welded half markers 20, forming a reflective marker 30 having two reflective faces 21.

Energy directors can be integrally incorporated on one side of the tongue and groove regions for increasing bonding strength.

FIGS. 13–16 further shows another half of a reflective marker 50 with reflective face 51, flat perpendicular sides 52, a planar top having corresponding regions of a tongue 54 and groove 56 with energy directors 58 (FIG. 14). This type of mini markers are ideally used as insert for snow plow able pavement markers, where, in a one-way traffic zone, only a half marker 50 is pre inserted into metallic body before agglutinating said metallic body on the roadways.

Where a two-way reflective marker is needed, two half markers 50 are sonically welded at the corresponding tongue 54 and groove 56 region before inserting the two-way marker into the metallic body. Multi angle sides, similar to the sides 5 used for marker 1 of FIGS. 1–5, can be incorporated integrally as part of marker 50 for use where a low profile reflective marker is preferable.

The present invention includes within its scope a method for making a reflective pavement marker comprising the steps of:

providing a simple two dimensional molds for integrally forming a one-piece reflective marker, injection molding a one-piece reflective marker integrally including one reflective face, two inclined sides each having protruded impact regions and angular finger grip slot and a base surface having a recessed area with guiding pins, injection mold a sealer sheets having predefined shape, textured exterior surface with recessed grooves and interior surface with energy director means, firmly plug in the guiding pins of a sealer sheet into the correspondingly located pin slots within the recessed area of a marker base surface prior to sonically welding the sealer sheet into the base area of the marker, thereby forming a unitary reflective pavement marker, providing hard resin coating composition, for adding abrasion resistant topcoat on the marker reflective faces, said hard resin coat can be selected from various available silane free resin coating composition, said hard resin composition can be dip coated, sprayed or brushed on the exterior surfaces of the marker.

It is understood that various changes or modifications can be made within the scope of the appended claims to the above-preferred process of forming one-piece reflective marker without departing from the scope and the spirit of the invention. The principle processes of this invention are not limited to the particular embodiments described herein. Various embodiments can employ the processes of this invention. This invention is not limited to the exact method illustrated and described; alternative methods can be used to form the intended monolithically formed reflective pavement marker of this invention.

What is claimed is:

1. A multi-sided retro-reflective pavement marker for providing visible marking within a multi-lane roadway surface, comprising:

An opaque colored, partially hollowed, structural body formed of polymeric material including two angular sides, two slanted finger grip slots, at least one transparent face having a plurality retro-reflective elements, lower horizontally-protruded, impact regions and a base having a recessed area having at least two guiding pin slots, a sealer sheet with a textured base with at least two guide pins and energy directors for agglutination to said recessed area of said pavement reflective marker.

2. The reflective pavement marker of claim 1, wherein the recessed area within said base surface having a depth of about 0.07–0.10 inch.

3. The reflective pavement marker of claim 1, wherein each of said slanted finger grip slots have an inclined surface that forms an angle of about 58–62 degrees with respect to the horizontal plane.

4. The reflective pavement maker of claim 1, wherein said marker has a width of about 4.0–10.0 inches, a depth of about 2.0–5.0 inches and a height of about 0.40–0.75 inches.

5. A multi-sided retro-reflective pavement marker having an inclined, transparent, retro-reflective face and a structural body including a plurality of internally positioned, load-carrying walls; wherein said reflective face having a planar exterior with multiple raised bumpers defining reflective cells, each of said cells having an interior surface with a plurality of light reflecting cube corner elements, said structural body having a vertical back defining the multiple hollow cavities, a planar top surface with a $1^{st}$ tongue and groove elements, in side by side relationship, a base surface having a $2^{nd}$ tongue and groove elements, wherein said structural body further comprises two multi-angular sides each of said sides having two tilted angular faces defining a lower, protruded impact region and further including half of a finger grip slot with a slanted angular surface at least one of said finger grip slots having a guiding pin, whereas the opposite finger grip slot has a guiding pin slot, such that two similar pavement markers can be assembled in back-to-back relationship via said tongue and groove and guide pin assemblies.

6. A multi-sided retro-reflective pavement marker of claim 5 wherein two similar multi-sided retro-reflective pavement markers can be firmly aligned, back to back to each other via said guide pins being received within said guide pin slots and sonically welded together, thereby forming a pavement marker with two opposing retro-reflective faces.

7. The multi-sided, retro-reflective pavement marker of claim 5, wherein a sealer sheet, having a textured exterior surface with multiple recessed grooves and an interior surface with at least two guide pins, and multiple energy director elements further comprises a periphery shape corresponding to said recessed area, within said base surface, and is sonically welded to said recessed area.

8. The multi-sided retro-reflective pavement marker of claim 5, wherein a hard resin coating composition is applied to the outer surface of said reflective faces as an abrasion resistant topcoat, said hard resin coat can be selected from various available resin coating compositions, said hard resin composition can be dip coated, sprayed or brushed on the exterior surfaces of said pavement marker.

* * * * *